US008079589B2

(12) United States Patent
Kinoshita et al.

(10) Patent No.: US 8,079,589 B2
(45) Date of Patent: Dec. 20, 2011

(54) SHEET CONVEYING APPARATUS AND IMAGE FORMING APPARATUS

(75) Inventors: Hiroyuki Kinoshita, Kawasaki (JP); Hideyuki Terashima, Kawasaki (JP); Naohiro Iwata, Yokohama (JP); Kosuke Yamamoto, Yokohama (JP); Akihiro Tomoda, Yokohama (JP); Ryosuke Sato, Kawasaki (JP); Akio Okubo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 12/465,977

(22) Filed: May 14, 2009

(65) Prior Publication Data

US 2009/0295079 A1 Dec. 3, 2009

(30) Foreign Application Priority Data

May 28, 2008 (JP) ..... 2008-139501

(51) Int. Cl.
*B65H 9/04* (2006.01)

(52) U.S. Cl. ..... 271/242

(58) Field of Classification Search ..... 271/242
See application file for complete search history.

(56) References Cited

U.S. PATENT DOCUMENTS

| | | | | |
|---|---|---|---|---|
| 4,953,846 | A * | 9/1990 | Azeta et al. | 271/251 |
| 4,961,091 | A | 10/1990 | Kasuya et al. | 355/321 |
| 5,049,948 | A * | 9/1991 | Brown et al. | 399/401 |
| 5,280,308 | A | 1/1994 | Takahashi et al. | 346/134 |
| 5,335,904 | A * | 8/1994 | Ryuzaki | 271/272 |
| 5,364,195 | A * | 11/1994 | Kanemitsu et al. | 347/4 |
| 5,580,042 | A | 12/1996 | Taniguro et al. | 271/274 |
| 5,620,174 | A | 4/1997 | Taniguro et al. | 271/10.12 |
| 5,725,319 | A | 3/1998 | Saito et al. | 400/629 |
| 6,059,285 | A | 5/2000 | Suga et al. | 271/228 |
| 6,273,418 | B1 * | 8/2001 | Fujikura et al. | 271/228 |
| 2007/0284810 | A1 * | 12/2007 | Nakazawa et al. | 271/228 |
| 2008/0061499 | A1 * | 3/2008 | DeGruchy et al. | 271/273 |
| 2008/0128980 | A1 | 6/2008 | Morya et al. | 271/227 |

FOREIGN PATENT DOCUMENTS

| | | |
|---|---|---|
| JP | 2-18244 | 1/1990 |
| JP | 11-20993 | 1/1999 |

OTHER PUBLICATIONS

Chinese Office Action issued by The State Intellectual Property Office of P.R. China, dated Mar. 11, 2011, in Chinese Application No. 200910202992.5.

* cited by examiner

*Primary Examiner* — Kaitlin Joerger
*Assistant Examiner* — Ernesto Suarez
(74) *Attorney, Agent, or Firm* — Fitzpatrick, Cella, Harper & Scinto

(57) ABSTRACT

A first conveying mechanism includes an intermediate conveying roller for conveying a recording sheet, an intermediate conveying roller shaft for supporting the intermediate conveying roller, an intermediate conveying roller drive mechanism for rotationally driving the intermediate conveying roller shaft, and a roller control mechanism for controlling movements of the intermediate conveying roller relative to the intermediate conveying roller shaft. The roller control mechanism performs skew correction along with conveying the recording sheet by rotating the intermediate conveying roller integrally with the intermediate conveying roller shaft while the intermediate conveying roller drive mechanism rotationally drives the intermediate conveying roller shaft and stops the rotational drive of the intermediate conveying roller shaft performed by the intermediate conveying roller drive mechanism after the skew correction to cause the intermediate conveying roller to be movable within a predetermined range in the axial direction of the intermediate conveying roller shaft.

15 Claims, 7 Drawing Sheets

SHEET CONVEYING APPARATUS AND IMAGE FORMING APPARATUS

BACKGROUND OF THE INVENTION

1. Field of the Invention

The present invention relates to a sheet conveying apparatus for conveying a sheet such as a recording sheet in an image forming apparatus such as a printer.

2. Description of the Related Art

In general, an image forming apparatus such as a printer has a conveying mechanism for conveying a sheet and a skew correcting mechanism for correcting skew of the sheet in a conveying direction.

The conveying mechanism includes a conveying roller rotated by a driving source and a pinching roller which is disposed opposite to the conveying roller to pinch the sheet and driven by the rotation of the conveying roller. The conveying mechanism conveys the sheet by rotating the conveying roller.

The skew correcting mechanism corrects the skew of the sheet in the conveying direction by abutting the front edge of the sheet against a registration roller or a registration shutter disposed upstream in the conveying direction of the sheet from an image forming section.

When skew correction is performed for a skewed sheet, the sheet is twisted between the skew correcting mechanism and the conveying mechanism, thereby generating a turning force M as shown in FIG. 7. This may cause skew again due to the turning force M after the skew correction of the sheet, which is to be sent to the image forming section.

As shown in FIG. 7, conveying rollers R1, R2, and R3 are supported by a rotating shaft C in a conventional image forming apparatus. The conveying rollers R1, R2, and R3 are attached to the rotating shaft C in a unified manner in the rotation direction around the rotating shaft C and are attached to the rotating shaft C movably in the axial direction of the rotating shaft C with coil springs S1 to S6 interposed between the conveying rollers R1, R2, and R3. In this image forming apparatus, skew of the sheet P is corrected by abutting the front edge of the sheet P in the conveying direction against the registration roller A. The image forming apparatus eliminates a thrust force F, which is generated by the turning force M caused by the twist (distortion) of the sheet P after the skew correction, by moving the conveying rollers R1, R2, and R3 in the axial direction of the rotating shaft C. Thus, the foregoing turning force M is eliminated, thereby solving the above problem.

Moreover, the coil springs S1 to S6 bias the conveying rollers R1, R2, and R3, which have been moved by the thrust force F, from axial both sides of the conveying rollers R1, R2, and R3, respectively. This enables the conveying rollers R1, R2, and R3 to return to predetermined positions, respectively, in some cases (Refer to Japanese Patent Application Laid-Open No. H02-018244).

Further, Japanese Patent Application Laid-Open No. H11-020993 proposes an arrangement for correcting skew of a sheet by measuring a skew amount of the sheet by using a sensor and varying a rotation amount of a pair of registration rollers disposed on both sides of the sheet in the width direction, which is perpendicular to the conveying direction of the sheet. Moreover, in this arrangement, besides the skew correction of the sheet, conveying rollers disposed upstream in the conveying direction of the sheet from the registration rollers are moved in an axial direction parallel to the width direction of the sheet.

The foregoing arrangement disclosed in Japanese Patent Application Laid-Open No. H02-018244, however, has a problem that a conveying path is not stable until the sheet abuts against the conveying rollers for performing skew correction of the sheet, since the plurality of conveying rollers are always movable in the axial direction of the conveying shaft.

Moreover, the conveying rollers is attached to the conveying shaft in a unified manner in the rotation direction around the conveying shaft in the arrangement disclosed in Japanese Patent Application Laid-Open No. H02-018244. Therefore, if a skew correction amount of the sheet is relatively large, the skew correction of the sheet may be insufficient to remove the twist of the sheet in some cases. Therefore, in order to achieve a sufficient effect, more or less it is necessary to slide the sheet toward the conveying rollers. On the other hand, however, there is a need to suppress sliding of the sheet as much as possible in order to obtain a sufficient conveying force to convey the sheet and it is difficult to satisfy both of the conditions incompatible with each other.

Therefore, it is difficult to prevent skew of the sheet while reliably conveying the sheet and therefore it has conventionally been a cause of a difference in force between the left and right sides in the width direction of the sheet and an uneven conveying distance. Thus, particularly a high-resolution ink jet recording apparatus has a problem that color unevenness and density unevenness occur in an image recorded on the sheet.

Further, in the arrangement disclosed in Japanese Patent Application Laid-Open No. H11-020993, there is a need to provide a plurality of drive mechanisms in order to drive the sensor for detecting skew of the sheet and the plurality of conveying rollers independently of each other, which leads to a problem of an increase in manufacturing cost and upsizing of the apparatus.

SUMMARY OF THE INVENTION

Therefore, an object of the present invention is to solve the above problems and to provide a sheet conveying apparatus and an image forming apparatus capable of preventing skew of a sheet that occurs after skew correction of the sheet and favorably conveying the sheet.

In order to achieve the above object, according to an aspect of the present invention, there is provided a sheet conveying apparatus having a first conveying unit for conveying a sheet and a second conveying unit which is disposed downstream in the conveying direction of the sheet conveyed by the first conveying unit to convey the sheet. The apparatus conveys the sheet and performs skew correction for correcting the orientation of the sheet with the front edge in the conveying direction of the sheet abutting against the second conveying unit so as to make the front edge of the sheet perpendicular to the conveying direction. The first conveying unit includes a conveying roller member for conveying the sheet, a conveying shaft for supporting the conveying roller member, a roller driving unit for rotationally driving the conveying shaft, and a roller control mechanism for controlling movements of the conveying roller member relative to the conveying shaft. The roller control mechanism performs the skew correction along with conveying the sheet by rotating the conveying roller member integrally with the conveying shaft while the roller driving unit rotationally drives the conveying shaft and stops the rotational drive of the conveying shaft performed by the roller driving unit after the skew correction to cause the conveying roller member to be movable within a predetermined range in the axial direction of the conveying shaft.

According to the present invention, the sheet conveying apparatus is capable of stably conveying the sheet to the second conveying unit which performs skew correction of the sheet. Further, according to the present invention, the apparatus is capable of preventing distortion of the sheet which occurs along with the skew correction of the sheet and therefore preventing skew of the sheet caused by the distortion, a rotation caused by the distortion of the sheet, and unevenness in feed per revolution of the sheet from occurring after the skew correction.

Further features of the present invention will become apparent from the following description of exemplary embodiments with reference to the attached drawings.

DESCRIPTION OF THE EMBODIMENTS

A specific embodiment of the present invention will be described below with reference to accompanying drawings.

As an example of an image forming apparatus using an ink jet recording system, a facsimile machine is given for description. The facsimile machine includes a sheet conveying apparatus for conveying a recording sheet as a sheet.

Figure 1:
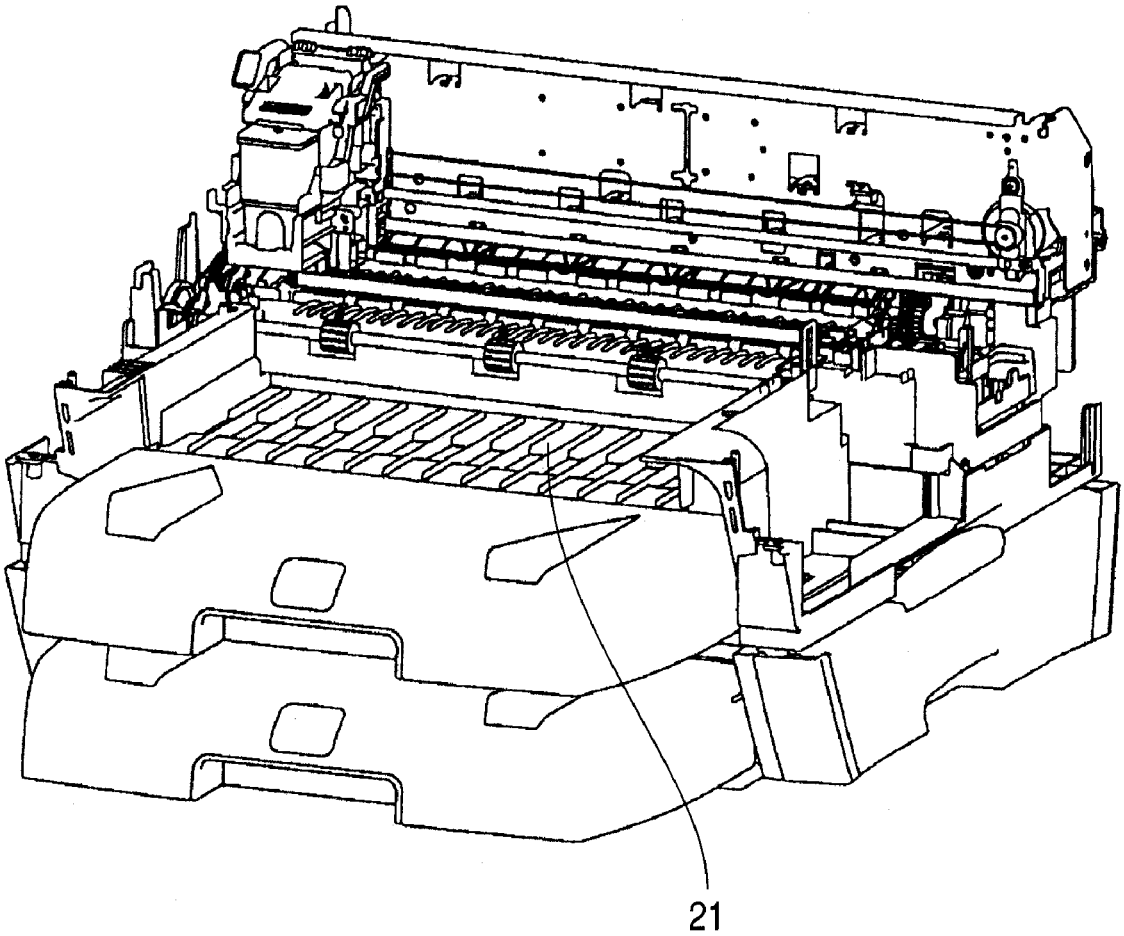
FIG. 1 is a perspective diagram illustrating a facsimile machine having a sheet conveying apparatus according to an embodiment.
Figure 2:
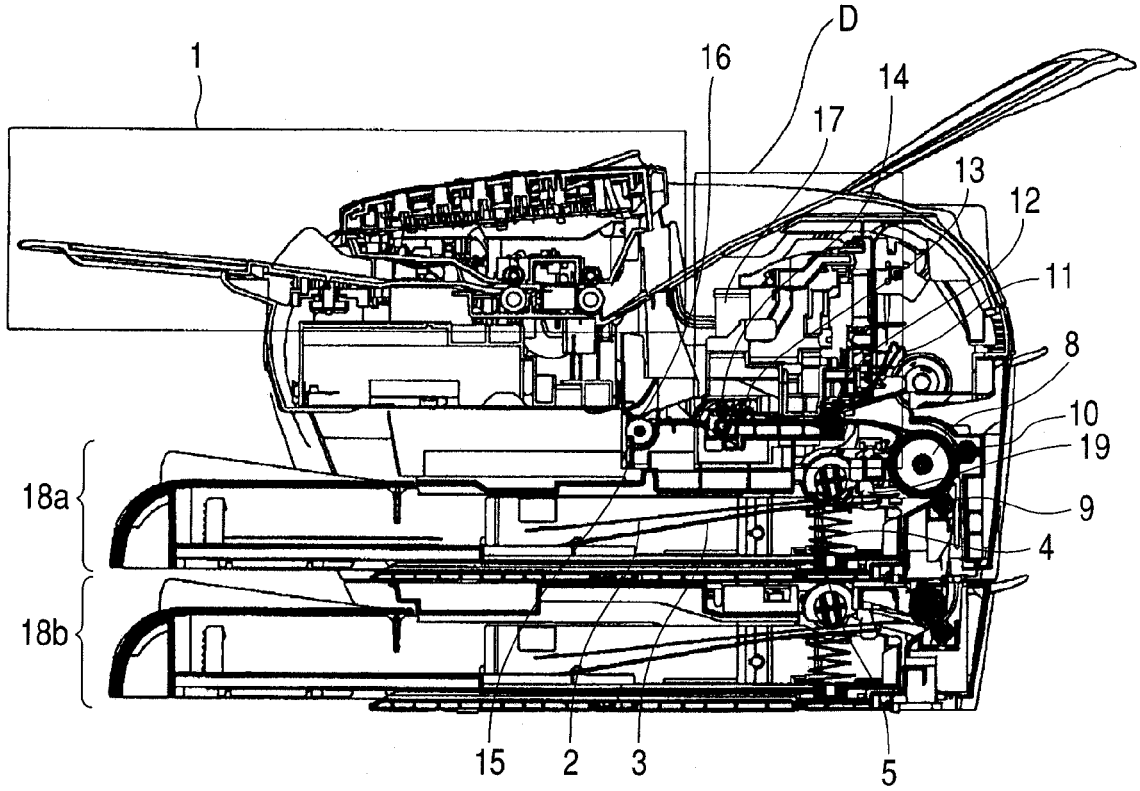
FIG. 2 is a cross section illustrating the facsimile machine having the sheet conveying apparatus according to the embodiment.
Figure 3:
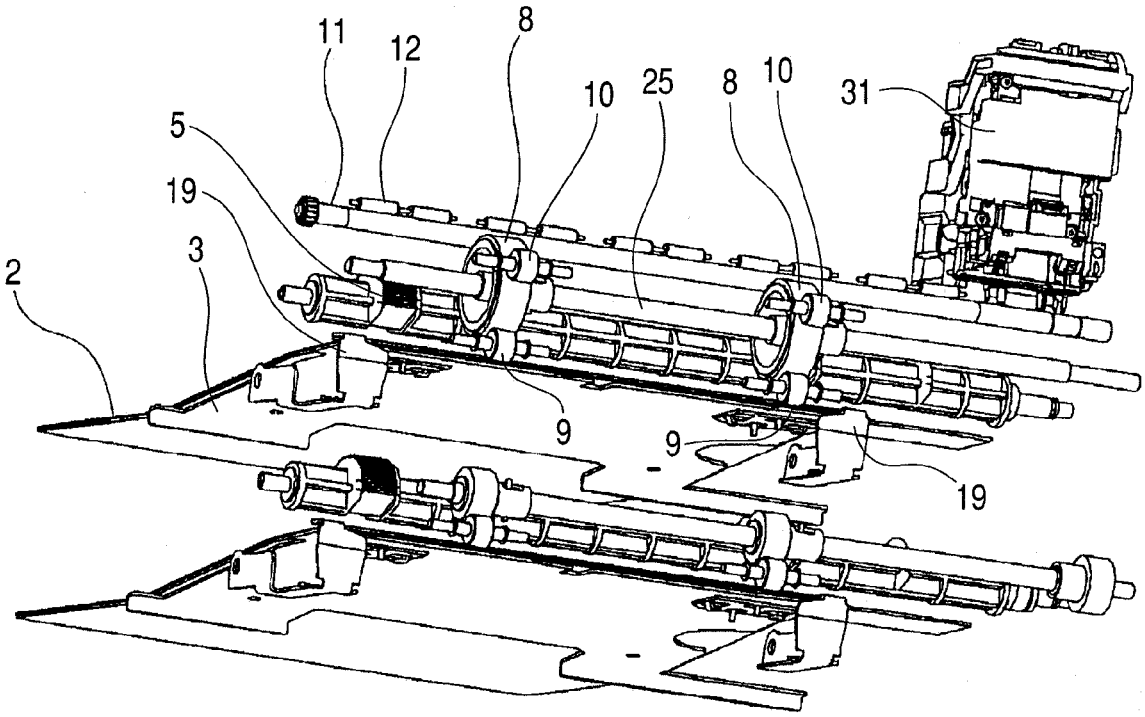
FIG. 3 is a perspective diagram illustrating a main conveying roller, an intermediate conveying roller, and a paper feed roller in the sheet conveying apparatus according to the embodiment.

FIG. 1 shows a perspective diagram exemplifying a facsimile machine having a sheet conveying apparatus according to the embodiment. FIG. 2 shows a cross section exemplifying the facsimile machine. FIG. 3 shows a perspective diagram illustrating respective rollers constituting a recording section of the facsimile machine.

First, with reference to FIGS. 1, 2, and 3, a recording section D of the facsimile machine will be described below. The sheet conveying apparatus of this embodiment includes a paper feed section made up of two parts, namely an upper paper feed section and a lower paper feed section. As shown in FIG. 2, the paper feed section has cassettes 18*a* and 18*b* each capable of housing a plurality of stacked sheets. These upper and lower paper feed sections have substantially the same functions and structure. Therefore, the following description is made primarily only with respect to the upper paper feed section.

The cassette 18 included in the sheet conveying apparatus is detachably attached to a lower part of the sheet conveying apparatus. Inside the cassette 18, a pressure plate 3 is provided for biasing the recording sheet 2. The pressure plate 3 is biased upward by a pressure plate spring 4, which is disposed opposite to a paper feed roller 5 described later, from the rear face of the pressure plate 3. Moreover, in the vicinity of the cassette 18, there is provided a separator 19 which picks up the front edge in the conveying direction of the recording sheet 2. Further, in the vicinity of the cassette 18, the paper feed roller 5 is disposed to separate and feed only one top sheet of the recording sheets 2 stacked and housed in the cassette 18 in cooperation with the separator 19.

The paper feed roller 5 is formed in a semicircle and has a circular arc surface, which comes in contact with the recording sheet 2 to feed the recording sheet 2, and a flat surface opposite to the recording sheet 2 a predetermined distance apart from the recording sheet 2. The paper feed roller 5 is placed in a paper wait standby state with the flat surface facing the recording sheet 2.

The sheet conveying apparatus of this embodiment includes a first conveying mechanism (a first conveying unit) for conveying the recording sheet 2 and a second conveying mechanism (a second conveying unit), which is disposed downstream in the conveying direction of the recording sheet 2 conveyed by the first conveying mechanism to convey the recording sheet 2. In addition, the sheet conveying apparatus of this embodiment conveys the recording sheet 2 and performs skew correction for correcting the orientation of the recording sheet 2 with the front edge in the conveying direction of the recording sheet 2 abutting against the second conveying mechanism so as to make the front edge of the recording sheet 2 perpendicular to the conveying direction.

The first conveying mechanism includes an intermediate conveying roller 8 as a conveying roller member for conveying the recording sheet 2 and an intermediate conveying roller shaft 25 as a conveying shaft for supporting the conveying roller member. Further, the first conveying mechanism includes an intermediate conveying roller drive mechanism (not shown) as a roller driving unit for rotationally driving the intermediate conveying roller shaft 25 and a roller control mechanism for controlling movements in the axial direction and the direction of rotation of the intermediate conveying roller 8 relative to the intermediate conveying roller shaft 25.

The second conveying mechanism includes a main conveying roller disposed on the downstream side in the conveying direction of the recording sheet 2 and a main conveying roller drive mechanism (not shown) for rotationally driving the main conveying roller.

Moreover, when feeding from the cassette 18, a one-turn clutch, which is not shown, picks up the recording sheet 2 only by one turn and sends out the recording sheet 2 to the intermediate conveying roller 8 as a conveying roller member which constitutes the first conveying unit.

Two intermediate conveying rollers 8 are supported a predetermined distance apart from each other on the intermediate conveying roller shaft 25. The intermediate conveying rollers 8 are disposed so as to convey the recording sheet 2 at around both ends thereof in the width direction, which is perpendicular to the conveying direction of the recording sheet 2.

An upstream conveying driven roller 9 and a downstream conveying driven roller 10 as driven roller members are pressed to the outer periphery of each intermediate conveying roller 8. The upstream conveying driven roller 9 and the downstream conveying driven roller 10 are supported movably in a direction of getting close to or away from the outer peripheral surface of the intermediate conveying roller 8. The recording sheet 2 is conveyed toward the main conveying roller 11 with being pinched between the intermediate conveying roller 8 and each of the upstream conveying driven roller 9 and the downstream conveying driven roller 10 in such a way as to fully wind around the outer periphery of the intermediate conveying roller 8.

Moreover, the facsimile machine of this embodiment employs an ink jet recording system which performs recording by discharging ink from an ink jet head (an ink jet recording unit) 17 as an image forming unit. As shown in FIG. 2, a recording section D has a carriage 31 equipped with the ink jet head 17 to reciprocate the ink jet head 17 in the width direction of the recording sheet 2 and a carriage drive mechanism (not shown) for driving the carriage 31. The recording section D is adapted to record an image or the like by discharging ink onto the recording sheet 2 by means of the ink jet head 17. Moreover, the facsimile machine of this embodiment includes a reading section 1 for reading the recording sheet 2 disposed above the sheet conveying apparatus.

The main conveying roller 11 has a function of conveying the recording sheet 2, which has been conveyed from the intermediate conveying roller 8, to the ink discharge section of the ink jet head 17 located on the downstream side in the conveying direction and then stopping the recording sheet 2 in a position enabling ink droplets to drop on an appropriate position on the recording sheet 2.

Further, in the sheet conveying apparatus, the main conveying roller 11 serves as a registration roller for correcting skew of the recording sheet 2 due to the abutment of the front edge of the recording sheet 2 conveyed from the intermediate conveying roller 8 against the main conveying roller 11.

A main conveying driven roller 12 is pressed to the main conveying roller 11 and follows the rotation of the main conveying roller 11 to convey the recording sheet 2 with the recording sheet 2 pinched between the main conveying driven roller 12 and the main conveying roller 11.

A first spur 14 is disposed on the downstream side in the conveying direction from the main conveying roller 11. The first spur 14 conveys the recording sheet 2 after recording operation to the downstream side in the conveying direction. The first spur 14 is provided in the position opposite to a first paper delivery roller 13. The first spur 14 is formed in a shape where acute projections are provided on the circumference of a thin metal disk to prevent ink from being transferred to the recording surface of the recording sheet 2 even in cases where the first spur 14 is in contact with the recording surface. The first spur 14 holds the recording sheet 2 at points with the tips of the projections and is driven by the first paper delivery roller 13 to convey the recording sheet 2.

Further, on the downstream side in the conveying direction from the first paper delivery roller 13 and the first spur 14, there are disposed a second paper delivery roller 15 and a second spur 16. The second paper delivery roller 15 and the second spur 16 have the same structures as the first paper delivery roller 13 and the first spur 14, respectively, to deliver the conveyed recording sheet 2 to a recording sheet delivery tray 21.

The entire conveying operation of the recording sheet has briefly been described in the above. The essential part of the present invention, however, is the configuration and operation of the intermediate conveying roller 8, and therefore the operations of the intermediate conveying roller 8 and its peripheral components will be described in detail below.

Figure 4:
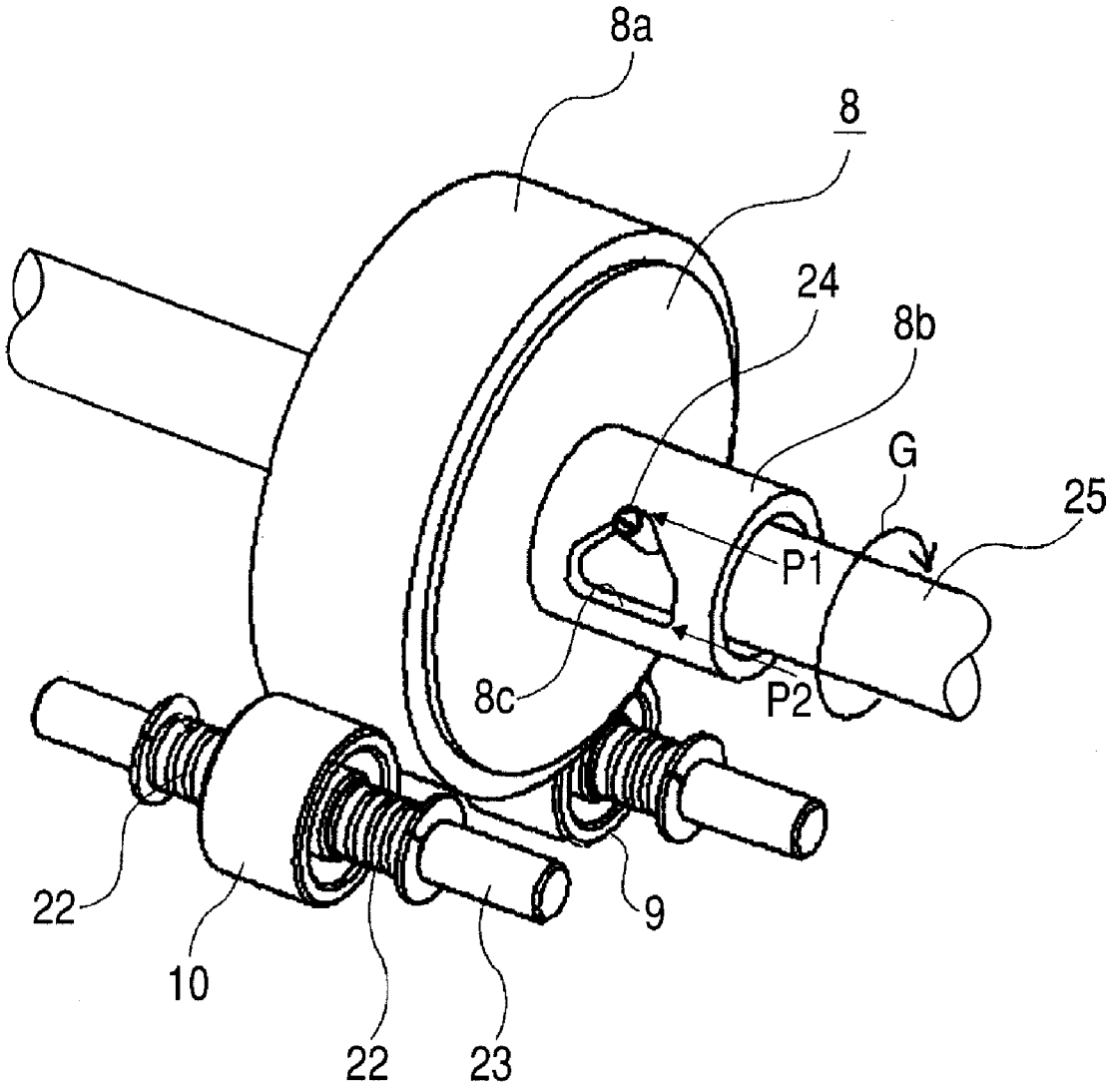
FIG. 4 is a partial enlarged view for describing the intermediate conveying roller in the embodiment.
Figure 5:
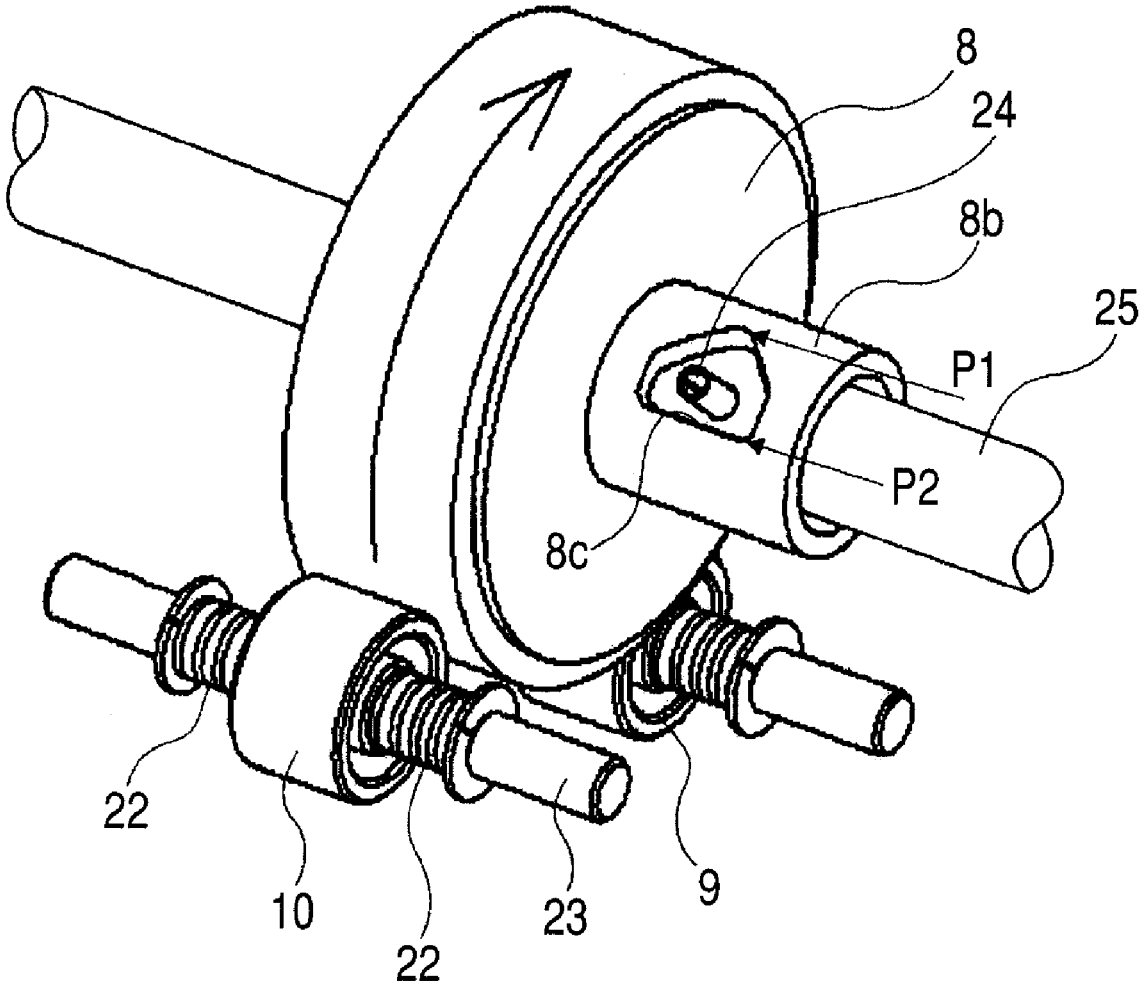
FIG. 5 is a partial enlarged view for describing the intermediate conveying roller in the embodiment.
Figure 6:
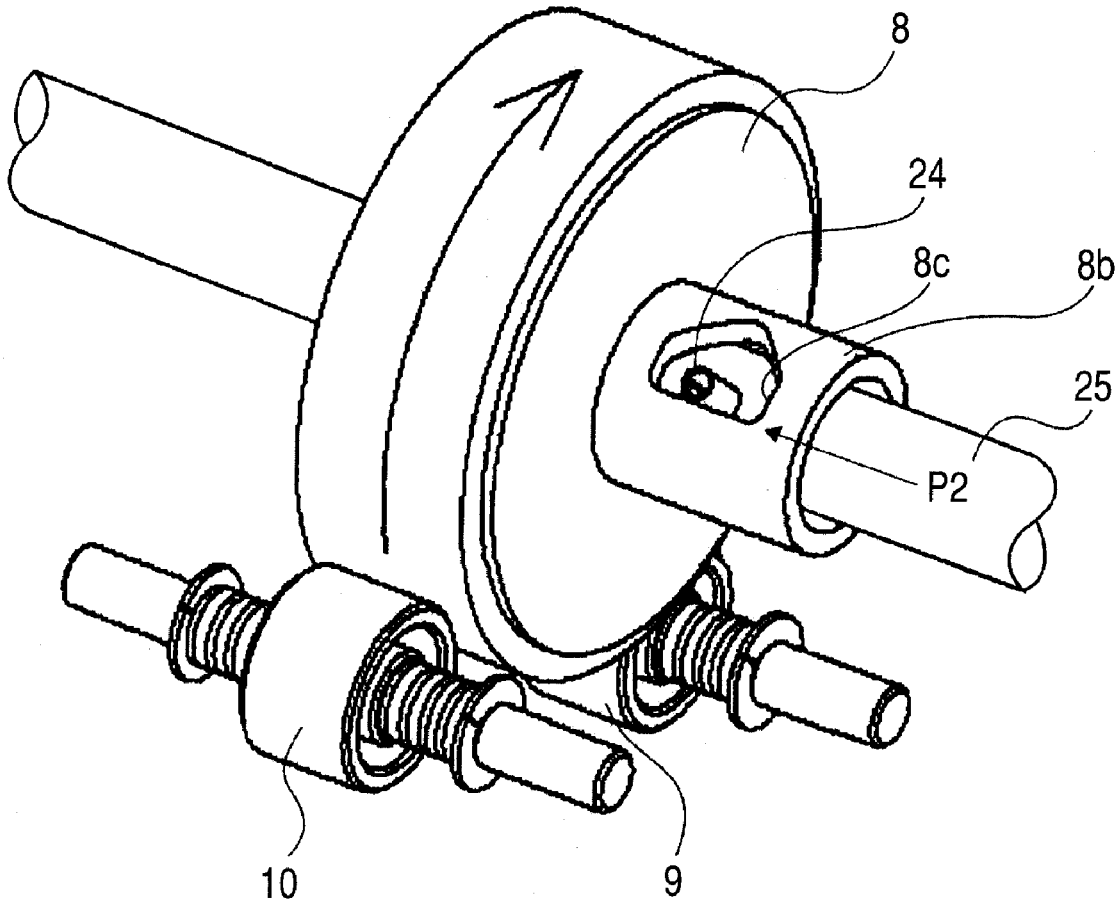
FIG. 6 is a partial enlarged view for describing the intermediate conveying roller in the embodiment.
Figure 7:
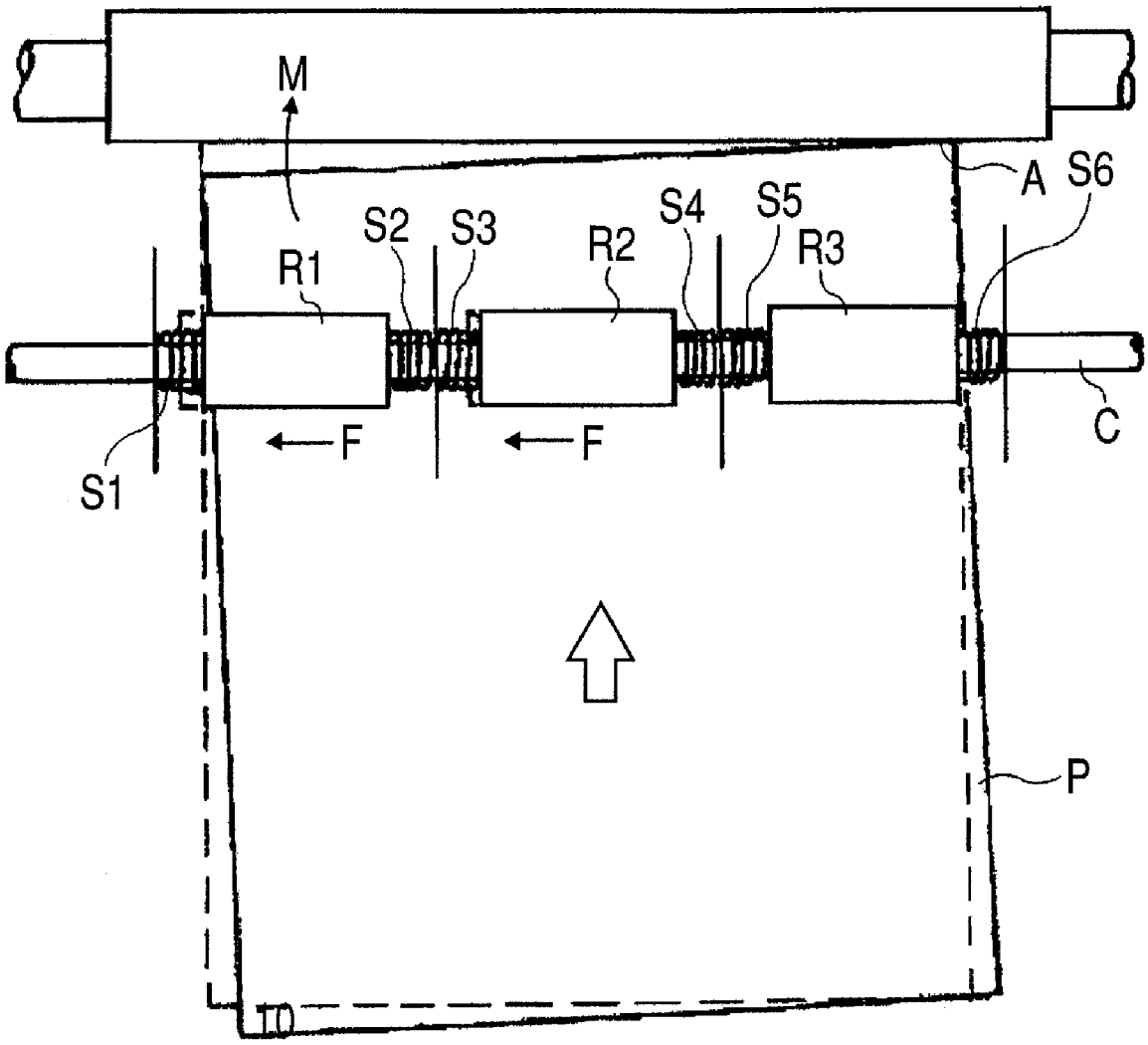
FIG. 7 is a schematic diagram for describing a configuration for performing skew correction and a configuration for correcting twist of a sheet by performing the skew correction in a conventional ink jet recording apparatus.

FIGS. 4, 5, and 6 each show a perspective diagram illustrating the operations of the intermediate conveying roller 8 and its peripheral components according to this embodiment.

The intermediate conveying roller 8 has a function of further conveying the recording sheet 2 received from the paper feed roller 5 and sending the recording sheet 2 to the main conveying roller 11. The body of the intermediate conveying roller 8 is formed of a resin material in a substantially cylindrical shape. On the periphery of the body, there is provided conveying rubber 8*a* formed of, for example, a rubber material or an elastomer resin which increases a frictional force of the outer periphery in order to reliably conveying the recording sheet 2.

Moreover, the intermediate conveying roller 8 is supported by the intermediate conveying roller shaft 25 passed through the bore of the body, having a degree of freedom with which the intermediate conveying roller 8 is movable in the direction of rotation (the rotation direction) around the intermediate conveying roller shaft 25 and in the axial direction of the intermediate conveying roller shaft 25. In addition, a sleeve 8*b* is integrally formed with the intermediate conveying roller 8 along the periphery of the bore of the intermediate conveying roller 8, where the intermediate conveying roller shaft 25 is passed through the sleeve 8*b*.

Further, the sleeve 8*b* has a cam hole 8*c* as a cam part with which the intermediate conveying roller shaft 25 engages, as a roller control mechanism. The cam hole 8*c* has an isosceles triangular portion where a movable range in the axial direction of the intermediate conveying roller shaft 25 becomes gradually narrower toward the rotation direction of the sleeve 8*b* in conveying the recording sheet 2 and a rectangular portion which continues to the base of the isosceles triangular portion. Therefore, the cam hole 8*c* has a pentagon shape on the whole.

As shown in FIG. 4, the inner periphery of the cam hole 8*c* has a first position P1 that makes the intermediate conveying roller 8 unmovable by limiting the movement of the intermediate conveying roller 8 in the axial direction of the intermediate conveying roller shaft 25 at one end formed by the apex of the isosceles triangular portion. In addition, the inner periphery of the cam hole 8*c* has a second position P2 that makes the intermediate conveying roller 8 movable within a predetermined range in the axial direction of the intermediate conveying roller shaft 25 at the other end formed by one side of the rectangular portion. Specifically, the inner periphery of the cam hole 8*c* controls whether the intermediate conveying roller 8 is movable or unmovable in the axial direction of the intermediate conveying roller shaft 25 by moving the intermediate conveying roller 8 to the first position P1 or to the second position P2.

The intermediate conveying roller shaft 25 is provided with a spring pin 24, which forms a roller control mechanism, fixed to the intermediate conveying roller shaft 25. The spring pin 24 is passed through the cam hole 8*c* of the sleeve 8*b*. The spring pin 24 is engaged with the inner periphery of the cam hole 8*c*, which limits the degree of freedom in movements of the intermediate conveying roller 8. Therefore, the intermediate conveying roller 8 is integrally formed with the intermediate conveying roller shaft 25, having the degree of freedom in movements within the predetermined range relatively. The spring pin 24 and the cam hole 8*c* constitute a limiting unit for limiting the movements of the intermediate conveying roller 8. Further, two sides of the isosceles triangle of the cam hole 8*c* form a first abutment portion and a second abutment portion, and the spring pin 24 forms a shaft-side abutment portion. A distance between the first abutment portion and the second abutment portion increases as being away from the apex of the isosceles triangle. Therefore, the length by which the intermediate conveying roller 8 is movable increases as being away from the apex. In other words, the intermediate conveying roller 8 is able to move longer as the phase in the rotation direction (the direction indicated by an arrow in FIG. 5) of the intermediate conveying roller 8 around the intermediate conveying roller shaft 25 advances in the rotation direction of conveying the sheet.

In conveying the recording sheet 2 in the conveying direction in this configuration, the intermediate conveying roller shaft 25 rotationally driven by the intermediate conveying roller drive mechanism (not shown) rotates in the direction indicated by an arrow G in FIG. 4. Thereafter, when the intermediate conveying roller shaft 25 is rotated in the direction of the arrow G, the spring pin 24 integrally provided on the intermediate conveying roller shaft 25 abuts against the portion in the first position P1 of the cam hole 8*c* of the intermediate conveying roller 8 and presses the inner peripheral end of the cam hole 8*c*.

As described above, the cam hole 8*c* is formed in a cam shape whose width is narrower in the rotation direction which is employed when the recording sheet 2 is conveyed in the conveying direction. Therefore, the intermediate conveying roller 8 moves in the axial direction, following the cam shape of the cam hole 8*c*, and is fixed to the intermediate conveying roller shaft 25 with the spring pin 24 abutting against the portion in the first position P1 of the cam hole 8*c* as shown in FIG. 4, thereby rotating integrally with the intermediate conveying roller shaft 25.

Moreover, the upstream conveying driven roller 9 and the downstream conveying driven roller 10 are in pressure contact with the outer peripheral surface of the intermediate conveying roller 8. The recording sheet 2 received from the paper feed roller 5 is pinched between the intermediate conveying roller 8 and each of the upstream conveying driven roller 9 and the downstream conveying driven roller 10. Therefore, the recording sheet 2 is conveyed along with the rotation of the intermediate conveying roller 8 and the front edge of the recording sheet 2 reaches the main conveying roller 11.

Even in cases where the front edge of the recording sheet 2 is not oriented perpendicular to the conveying direction at this point, the front edge of the recording sheet 2 is abutted against the outer peripheral surface of the main conveying roller 11, by which the front edge of the recording sheet 2 is aligned so as to be perpendicular to the conveying direction. In other words, in this embodiment, the main conveying roller 11 has a skew correction function combined with a registration roller function.

Further, the main conveying roller drive mechanism (not shown) rotationally drives the main conveying roller 11 to pinch the recording sheet 2 between the main conveying roller 11 and the main conveying driven roller 12. Thereafter, the intermediate conveying roller drive mechanism stops the rotational drive of the intermediate conveying roller 8, which is thereby put in an idling state.

Since the recording sheet 2 is pinched between the intermediate conveying roller 8 and each of the upstream conveying driven roller 9 and the downstream conveying driven roller 10 at this point, the rear edge of the recording sheet 2 remains skewed relative to the conveying direction. Therefore, a twist occurs in the recording sheet 2 and a conveying force is unevenly applied to both sides in the width direction of the recording sheet 2.

If the recording sheet 2 is continued to be conveyed after that along with the rotation of the main conveying roller 11, the intermediate conveying roller 8 is rotated by the movement of the conveyed recording sheet 2, in other words, an "accompanying rotation" occurs. Note that there is a clearance between the spring pin 24 and the inner periphery of the cam hole 8*c*. Specifically, the distance between the first position P1 and the second position P2 of the cam hole 8*c* is greater than the diameter of the spring pin 24. Therefore, when the intermediate conveying roller 8 rotates accompanying the movement of the recording sheet 2, the intermediate conveying roller 8 starts to rotate earlier than the intermediate conveying roller shaft 25, first.

The intermediate conveying roller 8 rotates around the intermediate conveying roller shaft 25, by which the first position P1 of the cam hole 8*c* moves away from the spring pin 24 as shown in FIG. 5. Therefore, the intermediate conveying roller 8 obtains the degree of freedom in the direction of rotation (the rotation direction) around the intermediate conveying roller shaft 25 and in the axial direction thereof relatively to the intermediate conveying roller shaft 25, within a range of the inner periphery of the cam hole 8*c*.

As described above, the two intermediate conveying rollers 8 are provided on the intermediate conveying roller shaft 25, and each of the two intermediate conveying rollers 8 obtains the degree of freedom in movements independently of each other. Therefore, the two intermediate conveying rollers 8 are moved independently of each other by uneven forces respectively generated on both sides (left and right) in the width direction of the recording sheet 2 due to a twist that has occurred in the recording sheet 2, thereby removing the twist of the recording sheet 2.

Further, each of the upstream conveying driven roller 9 and the downstream conveying driven roller 10 is supported in the bore by an intermediate driven roller shaft 23 in such a way as to be movable in a direction parallel to the axial direction of the intermediate conveying roller shaft 25. Moreover, intermediate driven roller springs 22 are abutted and biased against both side surfaces of each of the upstream conveying driven roller 9 and the downstream conveying driven roller 10 in the width direction of the recording sheet 2, so that the intermediate driven roller springs 22 are located in predetermined positions in a direction parallel to the axial direction of the intermediate conveying roller shaft 25. The intermediate driven roller springs 22 are provided as a return unit for returning each of the upstream conveying driven roller 9 and the downstream conveying driven roller 10. Therefore, the upstream conveying driven roller 9 and the downstream conveying driven roller 10 are adapted to follow the operation of the intermediate conveying roller 8 moving in the axial direction of the intermediate conveying roller shaft 25.

If the main conveying roller 11 further conveys the recording sheet 2 after that, the spring pin 24 reaches the second position P2 of the cam hole 8*c* to engage with the inner periphery of the cam hole 8*c* as shown in FIG. 6, and then the intermediate conveying roller 8 rotates accompanying the rotation of the intermediate conveying roller shaft 25.

The twist that has occurred in the recording sheet 2 has already been removed at this point, and therefore the recording sheet 2 can be fed to the recording section D by a stable conveying operation without uneven forces on the main conveying roller 11.

When the next conveyance of the recording sheet 2 is started after the completion of the series of the recording operations, the relative positional relationship between the intermediate conveying roller 8 and the intermediate conveying roller shaft 25 returns to the original positional relationship due to the cam operation between the spring pin 24 and the inner periphery of the cam hole 8*c* as described above. This prevents the intermediate conveying roller 8 from remaining in a biased position relative to the axial direction of the intermediate conveying roller shaft 25, thereby enabling the effect to be maintained even after the repetition of the paper feed operation and the conveying operation.

According to the embodiment, the sheet conveying apparatus is capable of stably conveying the recording sheet to the main conveying roller which corrects skew of the recording sheet. Further, according to the embodiment, the apparatus is capable of preventing distortion (twist) of the recording sheet 2 which occurs along with the skew correction of the recording sheet. Therefore, the apparatus is able to prevent skew of the recording sheet 2 caused by the distortion, a rotation caused by the distortion of the recording sheet 2, and unevenness in feed per revolution of the recording sheet 2 from occurring after the skew correction of the recording sheet 2. Therefore, according to the embodiment, the apparatus is capable of providing a high-quality output image which is low in color unevenness and in density unevenness. Further, in this embodiment, the roller control mechanism for controlling the movements of the intermediate conveying roller 8 can be formed in a relatively simple structure, thereby reducing a required space for the roller control mechanism to a relatively small one without increasing manufacturing cost to achieve sufficient effects.

Although the upper paper feed section and conveying section have been described with respect to the structure and the conveying operations in the above embodiment, the lower paper feed section and conveying section have substantially the same structures.

Moreover, the present invention is not limited to the above embodiment, but is applicable to a sheet conveying apparatus for conveying a sheet-type object extending between a conveying roller disposed on the upstream side and a conveying roller disposed on the downstream side in the conveying direction of the object and correcting skew of the object between these conveying rollers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-139501, filed May 28, 2008, which is hereby incorporated by reference herein in its entirety.

What is claimed is:

1. A sheet conveying apparatus having:

a first conveying unit for conveying a sheet;

a second conveying unit which is disposed downstream in the conveying direction of the sheet conveyed by the first conveying unit to convey the sheet, wherein the apparatus conveying the sheet and performing skew correction for correcting the orientation of the sheet with the front edge in the conveying direction of the sheet abutting against the second conveying unit so as to make the front edge of the sheet perpendicular to the conveying direction, wherein the first conveying unit includes a conveying roller member for conveying the sheet, a conveying shaft for supporting the conveying roller member such that the conveying roller member is movable in the axial direction of the conveying shaft and the rotational direction relative to the shaft, a roller driving unit for rotationally driving the conveying shaft, and a limiting unit for limiting the axial movement of the conveying roller member and the rotational movement of the roller member, and wherein the limiting unit limits the axial movement of the roller member to a first range in a state where the shaft rotates in the conveying direction to rotate the roller member, and limits the axial movement of the roller member to a second range larger than the first range in a state where the shaft is rotated by the roller that is rotated by the sheet conveyed by the second conveying roller.

2. The sheet conveying apparatus according to claim 1, wherein, after performing the skew correction, the limiting unit limits movement of the conveying roller member to within a predetermined range in the axial direction of the conveying shaft and in the direction of rotation around the conveying shaft.

3. The sheet conveying apparatus according to claim 2, wherein the conveying roller member is movable between a first position where the conveying roller member is unmovable in the axial direction of the conveying shaft and a second position where the conveying roller member movable in the axial direction of the conveying shaft.

4. The sheet conveying apparatus according to claim 3, wherein the limiting unit has a cam part which is provided on the conveying roller member and with which the conveying shaft engages and wherein the cam part controls the movement of the conveying roller member in the axial direction of the conveying shaft in a situation where the conveying roller member moves between the first position and the second position.

5. The sheet conveying apparatus according to claim 3, wherein the limiting unit moves the conveying roller member to the first position by a rotation of the conveying shaft caused by the roller driving unit before the skew correction and moves the conveying roller member to the second position by a rotation of the conveying roller member following the movement of the sheet conveyed by the second conveying unit after the skew correction.

6. The sheet conveying apparatus according to claim 1, wherein the first conveying unit has at least two conveying roller members provided on the conveying shaft and the conveying roller members are provided so as to be independently movable in the axial direction of the conveying shaft within a predetermined range.

7. The sheet conveying apparatus according to claim 1, wherein:

the first conveying unit has a driven roller member which is pressure-contacted with the conveying roller member so as to pinch the sheet between the driven roller member and the conveying roller member; and the driven roller member is provided movably in a direction parallel to the axial direction of the conveying shaft and has a return unit for returning the driven roller member to a predetermined position in the parallel direction.

8. The sheet conveying apparatus according to claim 7, wherein the driven roller member is supported movably toward and away from an outer peripheral surface of the conveying roller member.

9. An image forming apparatus having the sheet conveying apparatus according to claim 1 and an image forming unit which is disposed downstream in the conveying direction of the sheet from the second conveying unit, wherein the image forming unit forms an image on the sheet by reciprocating in a direction perpendicular to the conveying direction of the sheet conveyed by the sheet conveying apparatus.

10. The image forming apparatus according to claim 9, wherein the image forming unit is an ink jet recording unit.

11. A sheet conveying apparatus for correcting skew of a sheet by abutting the front edge of the sheet, which is conveyed by a first conveying roller, against a nip of a second conveying roller pair, wherein:

the first conveying roller includes a roller member which comes in contact with the sheet to apply a conveying force to the sheet and a shaft for supporting the roller member;

the roller member is movable in an axial direction of the shaft and in a rotational direction relative to the shaft; and a limiting unit for limiting the axial movement of the roller member and the rotational movement of the roller member wherein the limiting unit limits the axial movement of the roller member to a first range in a state where the shaft rotates in the conveying direction to rotate the roller member, and limits the axial movement of the roller member to a second range larger than the first range in a state where the shaft is rotated by the roller that is rotated by the sheet conveyed by the second conveying roller.

12. The sheet conveying apparatus according to claim 11, wherein the limiting unit limits movement in a first direction of the roller member by abutment between a shaft-side abutment portion provided on the shaft and a first abutment portion provided on the roller member and limits movement in a second direction of the roller member which is opposite to the first direction by abutment between the shaft-side abutment portion and a second abutment portion provided on the roller member.

13. The sheet conveying apparatus according to claim 12, wherein said limiting unit limits movement of the roller member according to a phase in a rotation direction of the roller member around the shaft, during a period between a state where the shaft-side abutment portion abuts against the first abutment portion and a state where the shaft-side abutment portion abuts against the second abutment portion.

14. The sheet conveying apparatus according to claim 12, wherein said limiting unit limits movement of the roller member to increase as the phase in the rotation direction of the roller member around the shaft advances in the conveying direction, during a period between a state where the shaft-side abutment portion abuts against the first abutment portion and a state where the shaft-side abutment portion abuts against the second abutment portion.

15. The sheet conveying apparatus according to claim 12, wherein said limiting unit limits a distance between the first abutment portion and the second abutment portion to increase as the phase in the rotation direction of the roller member around the shaft advances in the conveying direction.

* * * * *